US006192870B1

(12) United States Patent
Lambeth

(10) Patent No.: US 6,192,870 B1
(45) Date of Patent: Feb. 27, 2001

(54) FUEL INJECTOR

(75) Inventor: Malcolm David Dick Lambeth, Bromley (GB)

(73) Assignee: Lucas Industries Public Limited Company, London (GB)

( * ) Notice: Subject to any disclaimer, the term of this patent is extended or adjusted under 35 U.S.C. 154(b) by 0 days.

(21) Appl. No.: 09/232,789

(22) Filed: Jan. 19, 1999

(30) Foreign Application Priority Data

Feb. 27, 1998 (GB) ..... 9804110

(51) Int. Cl.[7] ..... F02M 37/04
(52) U.S. Cl. ..... 123/510; 123/470
(58) Field of Search ..... 123/470, 510, 123/509, 506, 446; 239/600

(56) References Cited

U.S. PATENT DOCUMENTS

| | | | | |
|---|---|---|---|---|
| 2,507,355 | | 5/1950 | Sola | 210/164 |
| 4,146,178 | * | 3/1979 | Bailey | 123/506 |
| 4,244,520 | | 1/1981 | Rathmayr | 239/88 |
| 4,641,621 | * | 2/1987 | Herdin | 123/446 |
| 5,265,804 | * | 11/1993 | Brunel | 123/506 |
| 5,280,774 | | 1/1994 | Entenmann et al. | 123/457 |
| 5,320,278 | * | 6/1994 | Kolarik | 123/446 |
| 5,345,913 | * | 9/1994 | Belshaw | 123/470 |
| 5,636,615 | * | 6/1997 | Shorey | 123/506 |
| 6,003,497 | * | 12/1999 | Rodier | 123/506 |
| 6,026,786 | * | 2/2000 | Groff | 123/509 |

FOREIGN PATENT DOCUMENTS

| | | | |
|---|---|---|---|
| 899295 | | 7/1949 | (DE) . |
| 195 20 036 | | 12/1995 | (DE) . |
| 151562 | | 8/1985 | (EP) . |
| 361237880 | * | 10/1986 | (JP) ..... 123/509 |

* cited by examiner

*Primary Examiner*—Carl S. Miller
(74) *Attorney, Agent, or Firm*—Ohlandt, Greeley, Ruggiero & Perle, L.L.P.

(57) ABSTRACT

A fuel injector comprises first and second housing parts, the first housing part being located within a bore or recess formed in the second housing part, the housing parts defining therebetween an inlet chamber, a delivery chamber axially spaced from the inlet chamber, and a filtration flow path interconnecting the inlet and delivery chambers to remove particulate contaminants from the flow of fuel therebetween.

8 Claims, 2 Drawing Sheets

FUEL INJECTOR

This invention relates to a fuel injector, and in particular to a fuel injector incorporating a filter arrangement for use in removing particulate contaminants from a flow of fuel. The fuel injector may take the form of a pump injector.

It is known to provide a fuel filter in a fuel system for a compression ignition internal combustion engine in order to remove particulate contaminants from the fuel to be injected as the presence of such contaminants may result in small openings in the injector becoming blocked, excessive wear or seizure of close fitting guides, or damage to impact surfaces. However, the provision of such filters restricts the rate of supply of fuel, and it may not be possible to supply fuel at a sufficiently high rate to allow efficient operation of, for example, a pump injector which requires fuel to be supplied thereto at a relatively high rate. The provision of such a filter may also increase the dimensions of the injector which can give rise to problems, for example, where the injector is intended for use in an engine having four or more inlet/exhaust valves.

According to the present invention there is provided a fuel injector comprising first and second housing parts, the first housing part being located within a bore formed in the second housing part, the housing parts defining therebetween an inlet chamber, a delivery chamber axially spaced from the inlet chamber and a filtration flow path communicating with both the inlet chamber and the delivery chamber to filter fuel flowing from the inlet chamber to the delivery chamber.

The inlet chamber, the delivery chamber and the filtration flow path are each conveniently of annular form, the filtration flow path being defined by a clearance between the first and second housing parts.

The first and second housing parts may comprise the spring housing and the cap nut of the injector housing.

By using a clearance between two existing parts of the injector housing as the filtration flow path, a filter arrangement can be provided in an injector without significantly increasing the dimensions of the injector.

Preferably, the injector includes at least one further inlet chamber, at least one further delivery chamber, and independent filtration flow paths between respective pairs of inlet and delivery chambers.

Such an arrangement is advantageous in that a greater fuel flow rate is permitted, the annular flow paths acting, in effect, as two or more filters arranged in parallel.

Figure 1:
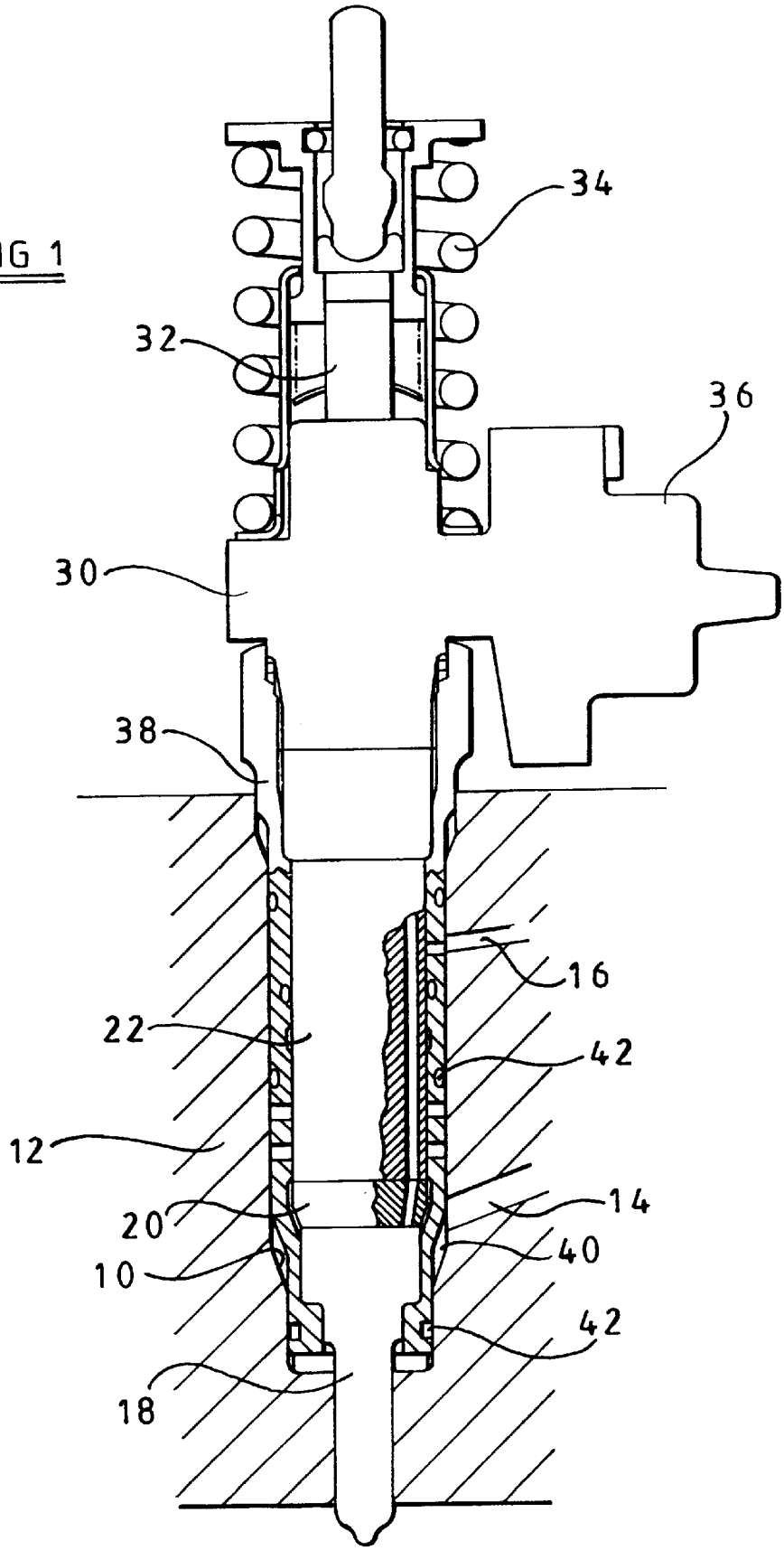
Figure 2:
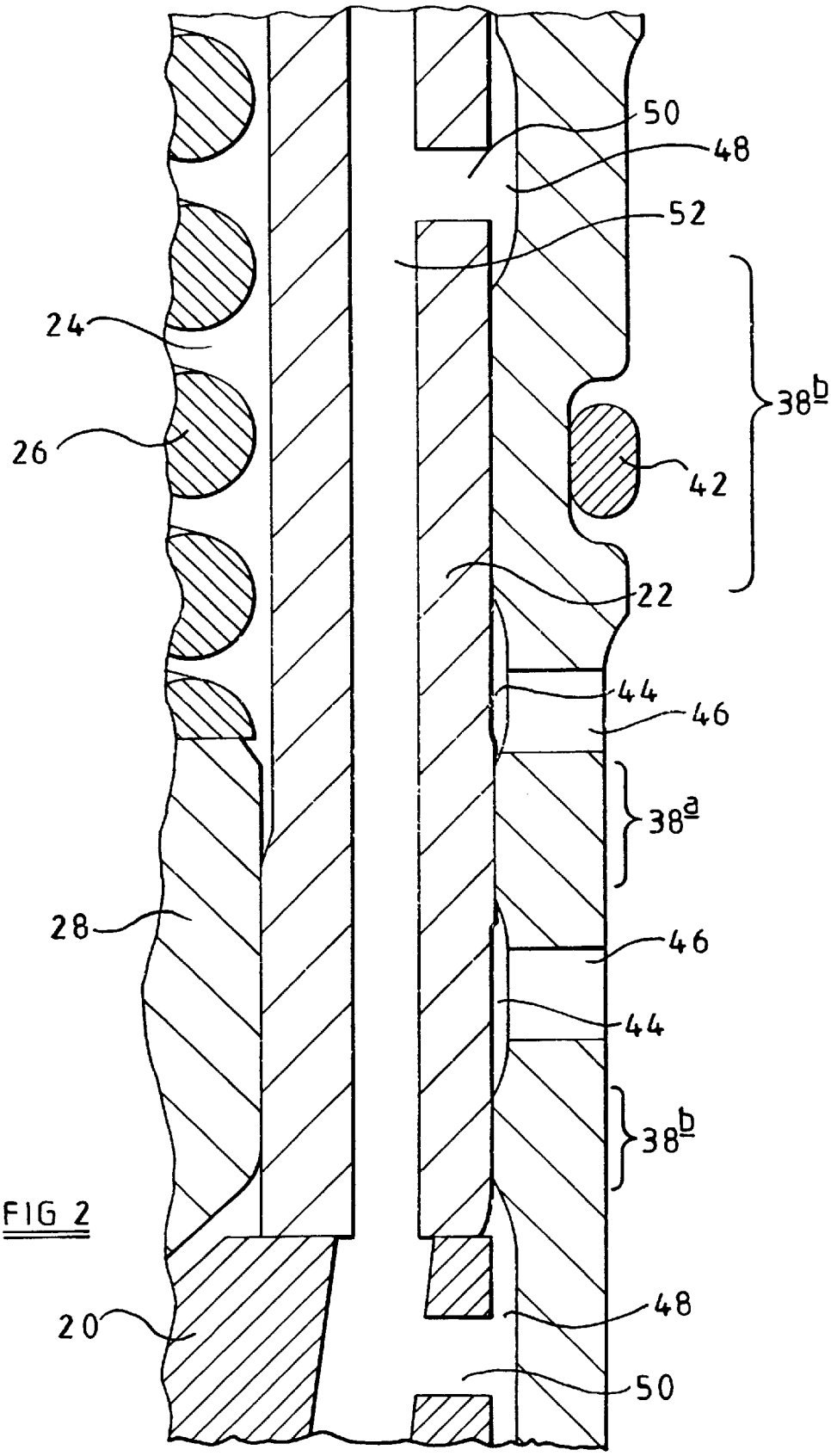

The invention will further be described, by way of example, with reference to the accompanying drawings, in which:

FIG. 1 is a view, partly in section, of a fuel injector in accordance with an embodiment; and FIG. 2 is an enlarged view of part of the injector shown in FIG. 1.

The fuel injector illustrated in the accompanying drawings is intended to be received within a bore 10 provided in a cylinder head 12, the cylinder head 12 being provided with a fuel supply passage 14 through which fuel is supplied to the injector from a fuel reservoir at relatively low pressure, for example a pressure of approximately 5 bar, and a backleak passage 16 connected to an appropriate drain reservoir.

The injector comprises a nozzle body 18 including a blind bore within which a valve needle is reciprocable, an end of the needle being engageable with a seating defined adjacent the blind end of the bore. The valve needle includes thrust surfaces which are orientated such that the application of fuel under pressure thereto applies a force to the valve needle urging the needle away from its seating to permit fuel to flow past the seating to one or more outlet openings provided in the nozzle body 18 downstream of the seating. The nozzle body 18 engages a distance piece 20 which in turn engages a spring housing 22. The spring housing 22 is provided with a bore defining a spring chamber 24 within which a compression spring 26 is located, an end of the compression spring 26 engaging a spring abutment member 28 which is carried by an end of the valve needle remote from the end arranged to engage the seating to bias the valve needle towards the seating.

The upper end of the spring housing 22 engages a pump housing 30 including a bore within which a pumping plunger 32 is reciprocable under the influence of a cam arrangement, a return spring 34 being provided to withdraw the plunger 32 from its bore. A spill valve arrangement 36 communicates with the bore of the pump housing 30 to control the operation of the injection. The spill valve arrangement 36 takes the form of an electromagnetically actuated valve which is actuable under the control of an appropriate control arrangement. The bore of the pump housing 30 further communicates through a passage (not shown) with the blind bore of the nozzle body 18.

A cap nut 38 engages the nozzle body 18 and secures the nozzle body 18, the distance piece 20 and the spring housing 22 to the pump housing 30. As illustrated in FIG. 1, the cap nut 38 and bore 10 together define a chamber 40 with which the supply passage 14 communicates, O-ring seals 42 being provided between the cap nut 38 and wall of the bore 10 in order to substantially prevent leakage of fuel from the chamber 40.

As illustrated in FIG. 2, the cap nut 38 is shaped to include a region 38*a* the inner surface of which engages the spring housing 22 to locate the spring housing 22 concentrically with the cap nut 38. Immediately above and below the region 38*a*, the inner surface of the cap nut 38 is provided with first and second annular recesses defining first and second annular inlet chambers 44 which communicate through respective passages 46 with the chamber 40. Immediately above the upper annular inlet chamber 44 and immediately below the lower annular inlet chamber 44, the inner surface of the cap nut 38 is shaped to include regions 38*b* of diameter slightly greater than the outer diameter of the spring housing 22 to define annular, cylindrical filtration flow paths which communicate with respective ones of the inlet chambers 44 and with respective delivery chambers 48 defined by annular recesses formed in the cap nut 38. The filtration flow paths may be defined, in part, by regions of the spring housing 22 of slightly reduced diameter, as shown in FIG. 2. As illustrated in FIG. 2, one of the delivery chambers 48 is defined, in part, by the outer surface of the distance piece 20. The delivery chambers 48 communicate through passages 50 with a supply passage 52 which extends within the distance piece 20 and the spring housing 22. The spill valve arrangement 36 controls communication between the supply passage 52 and the bore of the pump housing 30.

In use, starting from the position in which the pumping plunger 32 occupies its innermost position, the pumping plunger 32 being about to commence outward movement under the action of the spring 34, and with the spill valve arrangement 36 being actuated to permit communication between the bore of the pump housing 30 and the supply passage 52, movement of the pumping plunger 32 allows fuel to flow into the bore of the pump housing 30, the fuel being supplied from the chamber 40 through the passages 46 to the inlet chambers 44, and from the inlet chambers 44 past the regions 38*b*, through the delivery chambers 48 to the supply passage 52, and past the valve of the spill valve arrangement 36. As the filtration flow paths for fuel through the regions 38*b* are of small width, the inner diameter of the regions 38*a* of the cap nut 38 being only slightly greater than the outer diameter of the spring housing 22, it will be appreciated that particulate contaminants carried by the flow of fuel are unable to flow from the inlet chambers 44 to the delivery chambers 48. Clearly, the transmission of such particulate contaminants to the passage 52 and bore of the pump and the flow of such contaminants to the bore of the nozzle body 18 is prevented thereby reducing the risk of damage to the injector.

Continued movement of the plunger 32 results in the plunger 32 reaching its outermost position, and subsequent inward movement of the plunger 32 then commences. Whilst the spill valve arrangement 36 occupies its open condition, the inward movement of the plunger 32 displaces fuel past the spill valve arrangement 36, through the supply passage 52 and back through the filtration flow paths of the filter arrangement towards the fuel reservoir. The return flow of fuel through the filter arrangement acts to clean the filter arrangement thus reducing the risk of the filtration flow paths becoming blocked.

When injection is required to commence, the spill valve arrangement 36 is closed thereby terminating the return flow of fuel, continued inward movement of the pumping plunger 32 pressurizing the fuel within the bore of the pump housing 30 and the passages and bores in communication therewith, thus increasing the fuel pressure applied to the thrust surfaces of the valve needle, and a point will be reached beyond which the valve needle is able to lift from its seating against the action of the spring 26. Fuel injection then takes place. In order to terminate fuel injection, the spill valve arrangement 36 is actuated to once more permit fuel to flow from the bore of the pump housing 30 to the supply passage 52 and to the fuel reservoir. Such communication permits the fuel pressure within the bore of the pump housing 30 and the fuel pressure applied to the needle to fall rapidly with the result that the valve needle is able to return into engagement with its seating under the action of the spring 26.

As the filtration of fuel occurs as the fuel flows between various parts of the injector, it will appreciated that the dimensions of the injector are not increased significantly by the presence of the filter arrangement, and it will also be appreciated that by providing two separate fuel filtration flow paths fuel is permitted to flow to the passage 52 to a relatively high rate. It will be appreciated that, if desired, further filtration flow paths could be included with the result that fuel can be supplied at a greater rate.

Although in the description hereinbefore the filtration flow paths are of generally annular form, it will be appreciated that this need not be the case, and that the filtration flow paths could be defined, for example, by a series of grooves provided in the outer surface of the spring housing 22 or the inner surface of the cap nut 38. It will further be appreciated that the filtration flow paths could be defined between other components of the fuel injection, and that the invention is applicable to other types of fuel injector than that described hereinbefore.

What is claimed is:

1. A fuel injector comprising first and second housing parts, the first housing part being located within a bore or recess formed in the second housing part, the housing parts defining therebetween an inlet chamber and a filtration flow path communicating with both the inlet chamber and the delivery chamber to filter fuel flowing from the inlet chamber to the delivery chamber, at least one further inlet chamber, at least one further delivery chamber, and independent filtration flow paths between respective pairs of inlet and delivery chambers.

2. A fuel injector as claimed in claim 1, wherein the inlet chamber, the delivery chamber and the filtration flow path are each of annular form, the filtration flow path being defined by a clearance between the first and second housing parts.

3. A fuel injector as claimed in claim 1, wherein the first and second housing parts comprise a spring housing and a cap nut of a housing of the injector.

4. A fuel injector as claimed in claim 1, the injector further including at least one further inlet chamber, at least one further delivery chamber, and independent filtration flow paths between respective pairs of inlet and delivery chambers.

5. A fuel injection as claimed in claim 1, wherein each further inlet chamber, delivery chamber and filtration flow path is of annular form.

6. A fuel injector as claimed in claim 1, further comprising a fuel pump associated with the injector, and a spill valve controlling communication between the pump chamber of the fuel pump and the delivery chamber.

7. The fuel injector as claimed in claim 1, wherein the inlet chamber is defined by a part of the bore or recess formed in the second housing part.

8. The fuel injector as claimed in claim 1, wherein the delivery chamber is defined by a further part of the bore or recess formed in the second housing part.

* * * * *

UNITED STATES PATENT AND TRADEMARK OFFICE

CERTIFICATE OF CORRECTION

PATENT NO. : 6,192,870 B1
DATED : February 27, 2001
INVENTOR(S) : Malcolm David Dick Lambert It is certified that error appears in the above-identified patent and that said Letters Patent is hereby corrected as shown below:

Please change the inventor's last name from "LAMBETH" to -- LAMBERT --.

Signed and Sealed this

Sixteenth Day of October, 2001

*Attest:*

Nicholas P. Godici

*Attesting Officer*

NICHOLAS P. GODICI
*Acting Director of the United States Patent and Trademark Office*